US005257083A

United States Patent [19]

Chisholm et al.

[11] Patent Number: 5,257,083

[45] Date of Patent: Oct. 26, 1993

[54] STORAGE ASSEMBLY FOR DEVELOPMENT STATIONS IN AN ELECTROSTATOGRAPHIC REPRODUCTION APPARATUS

[75] Inventors: Hugh Chisholm, Churchville; John F. Stoffel, Rochester, both of N.Y.

[73] Assignee: Eastman Kodak Company, Rochester, N.Y.

[21] Appl. No.: 936,706

[22] Filed: Aug. 27, 1992

[51] Int. Cl.[5] ..... G03G 15/01

[52] U.S. Cl. ..... 355/326; 355/200; 355/245

[58] Field of Search ..... 355/200, 210, 215, 245, 355/260, 298, 326, 327

[56] References Cited

U.S. PATENT DOCUMENTS

| | | | |
|---|---|---|---|
| 4,841,336 | 6/1989 | Kusumoto et al. | 355/245 |
| 4,931,837 | 6/1990 | Abuyama et al. | 355/245 |
| 4,939,547 | 7/1990 | Miyaji et al. | 355/245 |
| 4,939,548 | 7/1990 | Yamada et al. | 355/245 |
| 4,949,399 | 8/1990 | Williams et al. | 355/260 |
| 4,956,673 | 9/1990 | Abuyama et al. | 355/245 |
| 4,963,936 | 10/1990 | Carter | 355/245 |
| 4,974,020 | 11/1990 | Takamatsu et al. | 355/208 |
| 4,987,451 | 1/1991 | Hikosaka et al. | 355/245 |
| 4,998,145 | 3/1991 | Haneda et al. | 355/327 |
| 4,999,680 | 3/1991 | Joseph et al. | 355/326 |
| 5,014,094 | 5/1991 | Amitani et al. | 355/326 |
| 5,014,095 | 5/1991 | Yamada | 355/327 |
| 5,017,962 | 5/1991 | Tsuji et al. | 355/210 |
| 5,043,764 | 8/1991 | Arnold et al. | 355/208 |
| 5,053,820 | 10/1991 | Preszler et al. | 355/245 |
| 5,077,584 | 12/1991 | Tanaka et al. | 355/260 |
| 5,083,164 | 1/1992 | Kamath et al. | 355/245 |
| 5,103,764 | 4/1992 | Fujiwara et al. | 355/326 |
| 5,111,245 | 5/1992 | DeCecca et al. | 355/245 |
| 5,153,646 | 10/1992 | Abuyama et al. | 355/245 |

*Primary Examiner*—A. T. Grimley
*Assistant Examiner*—Sandra L. Brasé
*Attorney, Agent, or Firm*—J. Gary Mohr

[57] ABSTRACT

A developer storage support assembly, in an electrostatographic reproduction apparatus having a removable development station for selective development of a latent image charge pattern on a moving dielectric member. The storage developer support assembly is constructed so as to isolate the operative parts of the development station, when in storage, from contact that may cause damage, as well as isolate the magnetic section of the development station so that it does not attract metallic particles that may damage the development station or the reproduction apparatus.

10 Claims, 2 Drawing Sheets

10

9
29
6
7
15
28
6
2
18
12
E
16
22c
22b
3
4
A
22a
L
24
25
P

STORAGE ASSEMBLY FOR DEVELOPMENT STATIONS IN AN ELECTROSTATOGRAPHIC REPRODUCTION APPARATUS

BACKGROUND OF THE INVENTION

This invention relates in general to development stations for an electrostatographic reproduction apparatus, and more particularly, to a support assembly for storing development stations in the electrostatographic reproduction apparatus when the development stations are not being used.

In typical electrostatographic reproduction apparatus, a charge pattern corresponding to an original image to be reproduced is formed on a dielectric member. A development station containing pigmented marking particles brings the particles into contact with the pattern, to develop the pattern. The developed pattern is subsequently transferred and fixed to a receiver member to form the desired reproduction.

While electrostatographic reproduction apparatus generally reproduce information in monochrome, some reproduction apparatus are capable of reproducing information in accent colors. Accent reproduction apparatus typically include three development stations, two containing colored marking particles and one containing black marking particles. A charge pattern corresponding to one color component, of the original information to be reproduced, is formed on the dielectric member. The development station for that color is activated to develop that charge pattern with the appropriate color marking particles. The developed charge pattern is then transferred to a receiver member prior to the receiver member exiting the reproduction apparatus. The receiver is then reinserted into the reproduction apparatus and the above procedure is repeated for a second color or for black marking.

In accent color apparatus, it is typical to replace a developer station containing one color, such as red developer particles, with another color developer station, such as one containing green developer particles. However, when this is done, the operator usually has no place to store the removed developer station, which typically will be used again. The operator, therefore, just lays it on the floor near the reproduction apparatus or on the floor of the reproduction apparatus, if such floor space is available. However, this subjects the developer station to debris contamination and in addition, since such developer stations have magnetic components, they have a tendency to pick up light metallic objects in or about the area where the operator placed the removed developer station. This debris and metal object contamination, upon the developer station being placed back into operational service, either drops off the developer station and lodges in the reproduction apparatus or remains on the developer station. Notwithstanding where the debris finally resides, it has a tendency to either jam, damage or contaminate the reproduction apparatus or the developer station.

In U.S. Pat. No. 4,841,336, incorporated herein by reference, there is disclosed a first and second position for the developing devices, but the patent does not address the contamination problem addressed by the present invention when the developing devices are removed from operation and placed in storage.

It is an object, therefore, of this invention, to provide an easy to use storage system for developer stations, when said stations are not being used, to prevent the above-identified problems.

SUMMARY OF THE INVENTION

This invention is directed to an image forming apparatus, such as an electrostatographic reproduction apparatus, having a developer storage support assembly for a removable development station. The image forming apparatus comprising:

a housing, a removable developer station, and a storage support assembly for temporary storage of the removable developer station, the storage support assembly including, base means having openings for allowing passage of debris, support means for retaining the removable developer station removed from the base means, and means for maintaining the base means removed from the housing.

In the above manner, the problem of debris contamination of a developer station, when removed from its operational position is solved.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
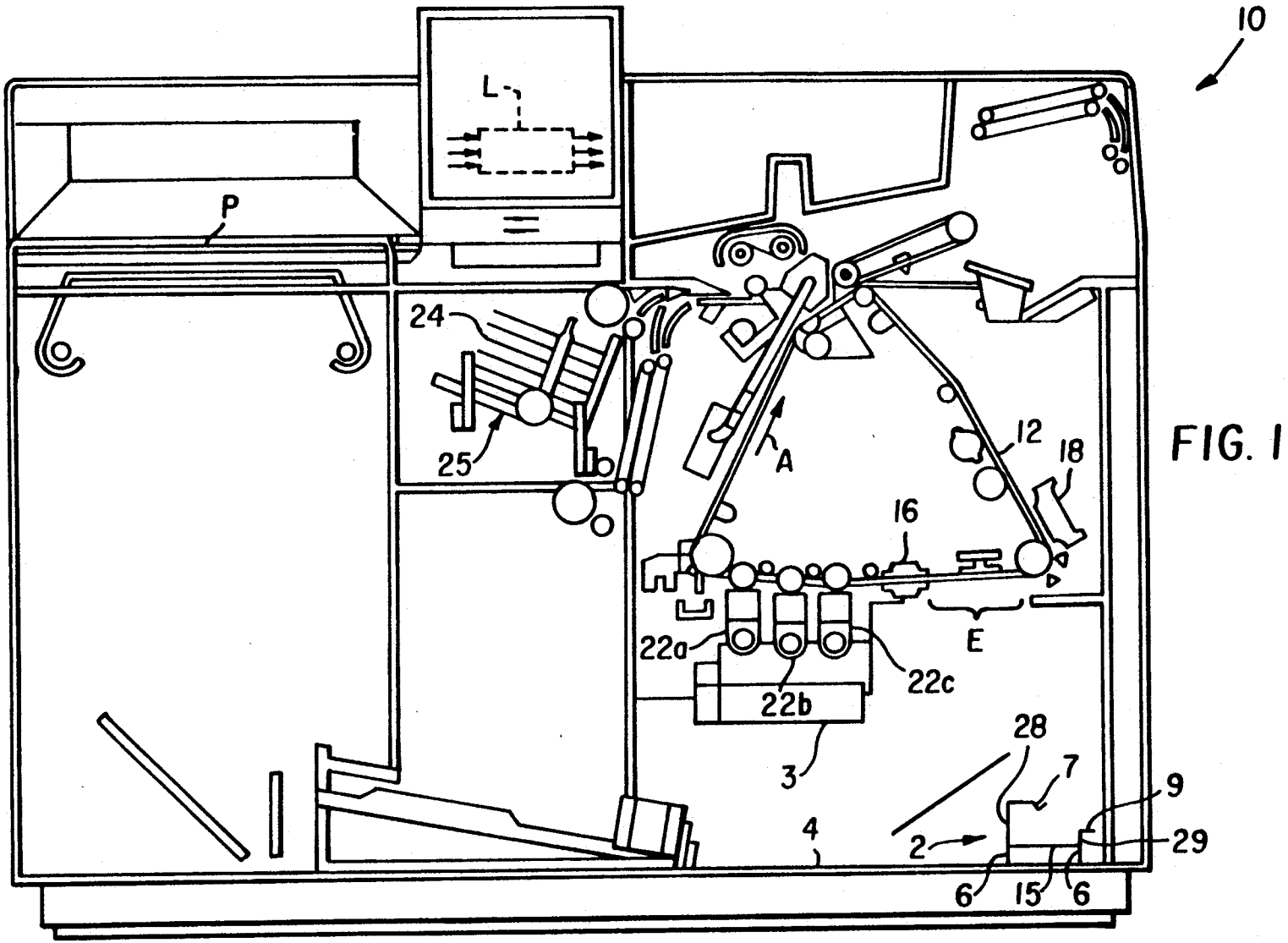
FIG. 1 is a front elevational view, partly in cross-section, of an exemplary electrostatographic reproduction apparatus including the development storage support assembly according to this invention.

The apparatus of the preferred embodiment will be described in accordance with an electrostatographic recording medium. The invention, however, is not limited to methods and apparatus for creating images on such a medium, as other media such as photographic film, etc. may also be used to advantage within the spirit of the invention.

Because electrostatographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, the apparatus will be described in its normal operational position, and terms such as upper, lower, horizontal, etc., will be used with reference to normal operating positions. It, however, may be manufactured, stored, transported and sold in an orientation other than the normal operational positions described.

Throughout the following description, similar reference characters refer to similar elements or members in all of the figures of the drawings.

Referring now to the accompanying drawings, FIG. 1 shows an exemplary electrostatographic reproduction apparatus, designated by the numeral 10, employing a developer storage support assembly 2 according to this invention. Reproduction apparatus 10 includes an endless dielectric member 12, such as a web, entrained about a plurality of rollers, one of which is driven by a suitable motor (not shown) to move web 12 about a closed loop path in the direction of arrow A. Web 12 is, for example, a composite structure having a photoconductive surface layer with a plurality of successive image receiving areas and a grounded conductive support layer. Of course, other electrostatographic reproduction or image forming apparatus, such as those employing a photoconductive drum or other image member, for example, are suitable for use with this invention.

Typically electrostatographic process stations are located about the periphery of web 12 in operative relation with the image receiving areas of web 12. Control of the electrostatographic process stations of reproduction apparatus 10 is accomplished by a logic and control unit L, which includes a microprocessor, not shown, but known in the art. The microprocessor receives operational input and timing signals, for example, from a sensor 16, as sensor 16 detects movement of web 12 about its closed loop path. Based on such signals and a control program of the microprocessor, control unit L produces signals to control the timing operation of the various electrostatographic process stations for carrying out the reproduction process. The creation of such a control program, for any one of a number of commercially available microprocessors, which are suitable for use with the present invention, is a conventional skill well understood in the art. The particular details of any such program would, of course, depend on the architecture of the designated microprocessor.

The electrostatographic process stations, of reproduction apparatus 10, function in the following manner to produce copies having accent color. A corona charger 18, coupled to a D.C. or biased A.C. electrical potential source (not shown), applies a uniform electrostatic charge to web 12 as it moves past charger 18. The uniform charge, in successive adjacent image receiving areas of web 12, is altered as web 12 passes through zone E, to form a latent image charge pattern in such areas corresponding to images of the information to be copied. For example, the latent image charge pattern is formed by exposure of the image-receiving area of web 12 to reflected light images of a particular area of the document located on a transparent platen P that is to be developed in a particular color. Of course, formation of image charge patterns on web 12 may be alternately accomplished by other suitable methods such as by exposure to electronic (e.g. LED array or laser scanner) or electrostatic produced images.

Travel of web 12 brings the image receiving areas, bearing the latent image charge pattern, into a development zone which includes development stations 22 contained in developer slots **22*a*, 22*b* and 22*c* mounted on a conventional support assembly 3. Development stations 22 contained in developer slots 22*a*, 22*b* and 22*c* may be, for example, of the magnetic brush type with one development station 22 containing a black toner and the other two containing a colored toners, such as red, green or blue. Such toners exhibit a triboelectric charge of a polarity opposite to that of the charge patterns to be developed. Under the control of the logic and control unit L, developer stations 22 are actuated to bring their associated toners into contact with corresponding image charge patterns so that the toner adheres to the image areas to be developed. This is usually accomplished by applying a single color toner each time web 12 passes the development zone containing developer slots 22*a*, 22*b* and 22*c***. That is, the image charge pattern corresponding to the red color, if accent red is being used, is developed with red toner, the charge pattern corresponding to the green color, if accent green is being used, is developed with green toner, and the charge pattern corresponding to the blue color, if accent blue is being used, is developed with blue toner.

While only three developer slots **22*a*, 22*b* and 22*c* are shown and described, with two containing a color toner such as red, green or blue and the other being a developer station containing a black toner, any number of developer slots may be used, to produce a developed accent color image on a receiver 24, such as a sheet of paper or transparency, contained in storage area 25**. It should be understood, however, that the existence of any loose debris or metallic particles in or about the electrostatographic process stations or the development stations, can cause serious problems for the rather sensitive process and development stations.

Figure 2:
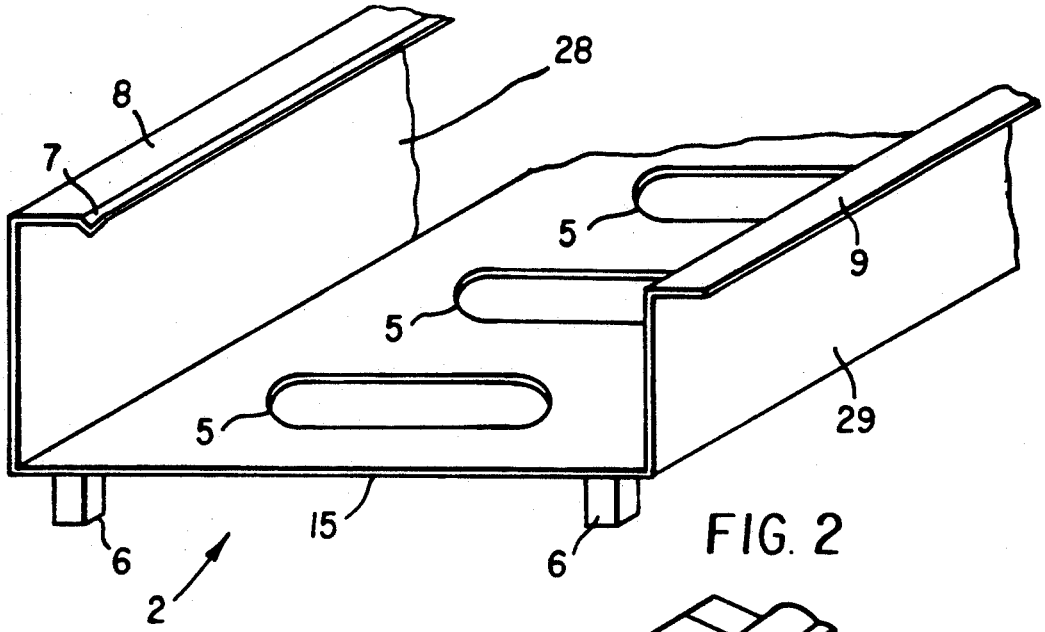
FIG. 2 is a perspective view of the storage support assembly, in accordance with the present invention.
Figure 4:
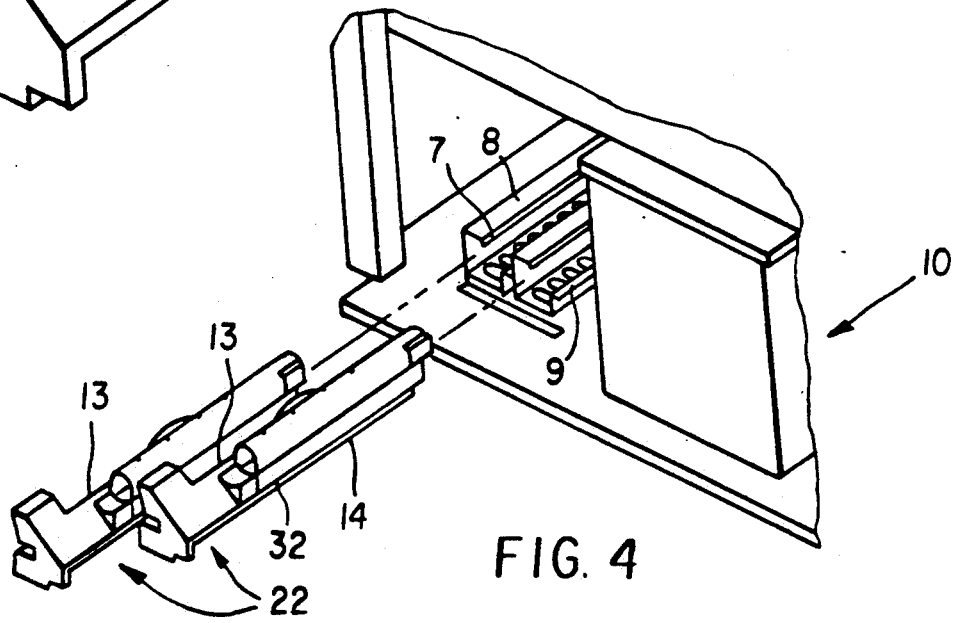
FIG. 4 is a perspective view of the way the development station slides into the storage support assembly of the present invention.

To prevent the above problems a developer storage support assembly 2 is provided with openings 5 (see FIG. 2) in base 15 of developer storage support assembly 2. Openings 5 allow particles, be they general debris or metallic debris, that may fall into developer storage support assembly 2, to fall through assembly 2 and thereby maintain assembly 2 free of debris that could attach or be attracted to any developer station 22 placed in developer storage support assembly 2. As shown in FIG. 1, developer storage support assembly 2 is located on floor 4, of reproduction apparatus 10, it, however, may be located in any other portion of reproduction apparatus 10 where space is available. Also depending on space availability there may be more than one development storage support assembly 2 in reproduction apparatus 10 (see FIG. 4). The location, however, of developer storage support assembly 2, should be such that any debris falling through openings 5 (see FIG. 2) of developer storage support assembly 2, be it general or metallic debris, will not lodge in a position where it will interfere with the operation of reproduction apparatus 10.

Developer storage support assembly 2 has support legs 6, attached to base 15, to maintain developer storage support assembly 2 removed or elevated from floor 4 of reproduction apparatus 10. This accomplishes two functions. The first, to maintain any developer station 22, stored in developer storage support assembly 2, sufficiently removed from general and light metallic contaminating debris located on and about floor 4, of reproduction apparatus 10. The second, to provide a space between floor 4, of reproduction apparatus 10, and openings 5, of developer storage support assembly 2, so that when debris falls into developer storage support assembly 2 or debris becomes dislodged from any developer station 22, when stored in developer storage support assembly 2, such debris will fall through openings 5 and onto floor 4, of reproduction apparatus 10, and be well enough removed from developer station 22 to prevent attachment or reattachment to developer station 22.

Figure 3:
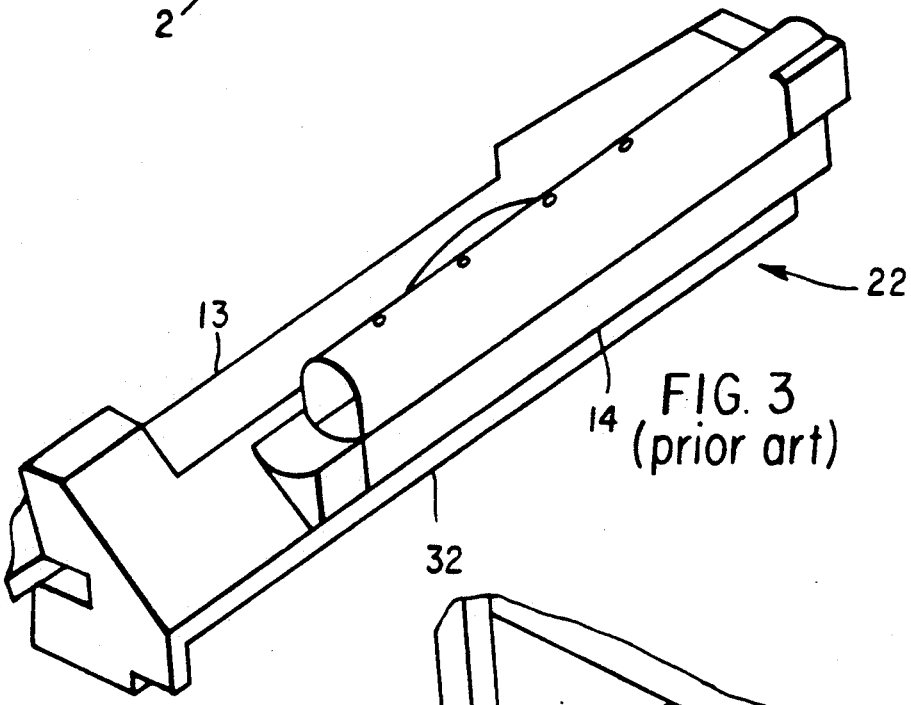
FIG. 3 (prior art)
FIG. 3 is a perspective view of a typical prior art development station used in the present invention.

Developer storage support assembly 2 (see FIG. 2) includes side walls 28 and 29 extending from base 15. Wall 28 has a lip 8 forming a recess 7 and wall 29 has a retaining ledge 9. Recess 7 and ledge 9, are both located for mating and support contact with protrusion 13 and support surface 14 (see FIGS. 3 and 4) of developer stations 22. Therefore, the placing of any developer station 22, within developer storage support assembly 2, automatically positions the magnetic section 32 and the operative parts of said development station 22 over openings 5 and isolated from contact with development storage support assembly 2. This prevents damage and contamination to any development stations 22 stored in developer storage support assembly 2, while allowing debris, that may be dislodged from said development station 22, to fall through openings 5. In this manner, one easily maintains the operating components and magnetic section 32, of any developer station 22, stored in developer storage support assembly 2, removed from contact with debris and safe from damage to its operating components, when removed from any one of developer slots 22*a*, 22*b* or 22*c*.

Mating of protrusion 13 and support surface 14, of each developer station 22, with recess 7 and support surface 9, of developer storage support assembly 2, may be accomplished either by sliding said mating parts in relation to one another or placing said mating parts in contact with one another, which mating action has a tendance to dislodge unwanted debris from developer station 22. Because the operator can, with out more then bending slightly, conveniently move any developer station 22 to and from developer storage support assembly 2, the operator is more likely to use a storage support assembly 2, than to bend over further to place developer station 22 on the floor, near reproduction apparatus 10, or any other place where developer station 22 or its magnetic section 32, would be subjected to contaminating debris or damage.

In operation, if an operator approaches reproduction apparatus 10 and wishes to produce a copy having an accent red area and the accent red development station 22 is not located in developer slot 22*a*, 22*b* or 22*c*, it will necessitate the removal of one development station 22, from one of developer slots 22*a*, 22*b* or 22*c*. The operator, therefore, removes said developer station 22, such as the one contained in developer slot 22*b*, of support station 3, and places it, for temporary storage, in any vacant developer storage support assembly 2, by either sliding it across recess 7 and ledge 9 or placing it in mating contact into recess 7 and onto ledge 9 of development storage support assembly 2. The operator then slides out or picks up developer station 22, containing the red developer, from developer storage support assembly 2 and places it in developer slot 22*b*, of support station 3. In this manner, neither developer station 22, containing the green developer, nor developer station 22, containing the red developer, comes into contact with any debris that could later be deposited into reproduction apparatus 10 causing adverse results.

While the above developer storage support assembly was directed to supporting a particular type of developer station, it should be emphasized that numerous changes may be made in the above described system without departing from the teachings of the invention. It being intended that all of the matter contained in the foregoing description, or shown in the accompanying drawings, shall be interpreted as illustrative rather than limiting.

I claim:

1. An image forming apparatus comprising:
a housing,
a removable developer station, and
a storage support assembly for temporary storage of the removable developer station,
the storage support assembly including,
base means having openings for allowing passage of debris,
support means for retaining the removable developer station removed from the base means, and
means for maintaining the base means removed from the housing.

2. The image forming apparatus of claim 2 wherein the support means includes a first and a second substantially vertical wall, in relation to the base means.

3. The image forming apparatus of claim 2 wherein an extension of the first substantially vertical wall has a recess for mating with a first section of the developer station and an extension of the second vertical wall has a flat surface for mating with a second section of the developer station.

4. The image forming apparatus of claim 3 wherein the extensions of the first and second substantially vertical walls maintain any magnetic components and movable parts, of the developer station, isolated from contact with the housing, the substantially vertical walls and the base means.

5. The image forming apparatus of claim 4 wherein the extensions of the substantially vertical walls further maintains any magnetic components of the developer station spaced above the openings of the base means.

6. A storage support assembly for temporary storage of a removable developer station, the assembly comprising:
base means having openings for allowing passage of debris,
a first and a second substantially vertical wall,
extension means of the first and second substantially vertical walls for retaining the removable developer station isolated from the walls and the base means, and
mounting means for maintaining the base means elevated.

7. The storage support assembly of claim 6 wherein the extension means of the first substantially vertical wall has a recess for mating with a first section of the developer station and the extension means of the second substantially vertical wall has a flat surface for mating with a second section of the developer station.

8. The storage support assembly of claim 6 wherein the extension means of the first and second substantially vertical walls maintain any magnetic components and movable parts, of the developer station, isolated from contact with the vertical walls and the base means.

9. The storage support assembly of claim 8 wherein the extension means of the substantially vertical walls maintain any magnetic components of the developer station spaced above the openings of the base means.

10. An image forming apparatus having means for moving an image member past a removable development station, said apparatus including a first support means for supporting a development station in operative relation with the image member and a second support means for supporting a development station in a storage position, said second support including a base and means for maintaining a supported developer station elevated from the base wherein the base has openings for passage of debris, the apparatus has a floor and the second support includes means for maintaining the base above the floor.

* * * * *